United States Patent [19]

Janz et al.

[11] Patent Number: 4,629,500

[45] Date of Patent: Dec. 16, 1986

[54] USE OF NOVEL ROTARY TUBULAR KILN

[75] Inventors: Helmut Janz, Viersen; Fritz Rodi, Moers; Alfred Soppe, Issum; Jakob Rademachers, Krefeld, all of Fed. Rep. of Germany

[73] Assignee: Bayer Aktiengesellschaft, Leverkusen, Fed. Rep. of Germany

[21] Appl. No.: 637,469

[22] Filed: Aug. 3, 1984

[30] Foreign Application Priority Data

Aug. 9, 1983 [DE] Fed. Rep. of Germany ..... 3328709

[51] Int. Cl.[4] ..... C21B 13/08

[52] U.S. Cl. ..... 75/0.5 BA; 252/62.56; 423/634

[58] Field of Search ..... 75/36, 1 R, 0.5 BA, 75/33, 34, 35; 266/173, 145; 422/209; 432/111; 423/634, 633; 252/62.56

[56] References Cited

U.S. PATENT DOCUMENTS

| | | | |
|---|---|---|---|
| 2,600,871 | 6/1952 | Helwig | 422/209 |
| 2,839,381 | 6/1958 | Lee | 75/33 |
| 2,900,236 | 8/1959 | Speed et al. | 75/33 |
| 2,988,442 | 6/1961 | Tanner | 75/34 |
| 3,320,049 | 5/1967 | Hendrickson | 75/35 |

FOREIGN PATENT DOCUMENTS 414362 3/1936 Belgium .

*Primary Examiner*—Melvyn J. Andrews

*Attorney, Agent, or Firm*—Sprung Horn Kramer & Woods

[57] ABSTRACT

In a rotary tubular kiln for carrying out gas-solids reactions, comprising an indirectly heated, rotatable reaction tube with inner baffles which is provided with charging and removing devices for solid and gas inlet and outlet lines, the improvement which comprises forming the baffles as a central tube which is sealed on both sides and runs along the total length of the kiln, and a spiral which is tightly connected to the central tube and also to the outer rotatable tube. Lifting blades are uniformly distributed along the inner periphery of the rotatable tube. The kiln is suitable for carrying out oxidation, reduction, chlorination, roasting, decomposition, catalytic, annealing and/or cooling processes, e.g. the conversion of hematite to magnetite or goethite to iron.

4 Claims, 2 Drawing Figures

USE OF NOVEL ROTARY TUBULAR KILN

The present invention relates to a rotary tubular kiln for carrying out gas-solid reactions, comprising an indirectly heated, rotating reaction tube with inner baffles which is provided with charging and removing devices for solids and gas inlet and outlet lines.

The present invention relates, moreover, to the use of the rotary tubular kiln.

Rotary tubular kilns are used for carrying out numerous reactions between gases and pourable, non-tacky solid substances (Chem.-Ing.-Techn. 51 (1979) No. 8, P. 771–778; Verlag Chemie, Weinheim).

Indirectly heated rotary tubular kilns are used in particular in processes, in which a guiding of gas and a composition of gas, which are independent of the type and quantity of flue gas, are required within the rotary tube.

Indirectly heated kilns of this type may either be equipped with electrical heating elements or with burners. Even in oil or gas-heated kilns, the external heating produces a guiding of gas and a composition of gas within the rotary tube which are independent of the type and quantity of flue gas. Desired temperature profiles may be set by means of separately controllable heating zones.

Since rotary tubular kilns of this type may be operated in a gas-tight manner, they may be operated under elevated gas pressure. For this reason they are preferably used for carrying out reactions under a desired gas atmosphere from which atmospheric oxygen has been completely excluded. They are particularly advantageous for reactions in which there is a high risk of explosive mixtures being formed with air, as is the case with slightly combustible gases and finely-divided, pyrophoric powders.

Rotary tubular kilns have the advantage that the reaction is continuously carried out in a moving bed. They suffer, however, from the disadvantage that the reactants are mixed together in a transverse and longitudinal direction as they pass through the kiln during the course of the operation. As a result, the individual particles are subjected to different reaction conditions corresponding to their varying residence times in the individual zones.

Since the properties of solids change during the reaction, it is difficult to calculate the average residence time of the individual particles in advance. It can only be determined by trial, for example by doping. Under these circumstances, relatively wide residence time spectra are usually obtained. This results in a varying duration of treatment for the individual grain, and this difference may lead to the quality of sensitive products being substantially impaired.

The present invention provides a rotary tubular kiln, in which it is possible to achieve as narrow a residence spectrum as possible while achieving the best contact possible between gas and solid substance.

Measures for obtaining narrower spectra of periods of residence are already known. Thus it has now become conventional to install tightly connected spirals to the wall of the kiln, which constrain the transport of the product. Measures are also described which are supposed to bring about better contact between the gas and the solid. Thus for example, spiral strips or lifting blades are installed which lift the product and allow it to fall transversely with respect to the flow of gas.

An apparatus is known from patent DE-A No. 3,025,716 which provides an improved contact between gas and solid substance and a uniform residence time by means of a spiral-shaped constrained transporting path, along which the gas is passed. The disadvantage of this indirectly heated, rotating spiral-shaped reaction tube is that the supply of the solid is difficult and in the normal embodiment it is intermittent at each revolution of the spiral tube. A further disadvantage results from the fact that the reactive gases may only be passed along above the loose material and this means that it is impossible to achieve a very high degree of usefulness of the gas.

It has now become possible to construct a rotary tubular kiln which meets the above-mentioned requirements extremely well without giving rise to the above-mentioned disadvantages.

The rotary tubular kiln, according to the present invention, for carrying out gas-solid reactions, comprises an indirectly heated, rotating reaction tube with inner baffles which is provided with charging and removing devices for solids and gas inlet and outlet lines, and is characterized in that the baffles consist of a central tube which is sealed on both sides and runs along the total length of the kiln and a spiral which is not only tightly connected to the central tube but also to the outer rotary tube.

In a rotary tubular kiln of this type a constrained transport takes place without back mixing by means of the sealed spiral. This gives rise to a narrow residence time spectrum of the individual particles; each particle of solid substance is thus subjected to the same conditions and has the same properties.

In a particularly preferred embodiment of the present invention, the inner periphery of the outer rotary tube is additionally provided with lifting blades. These lifting blades may be arranged, as required, in the rotary tubular kiln, a uniform distribution generally being presented.

The tubular kiln should be sealed in a gas-tight manner for carrying out most reactions.

The above-mentioned baffles which are contained in the rotary kiln, and which are referred to below as a sealed spiral with lifting blades, are particularly effective if the reaction gas which is moved in a spiral-shaped manner around the central tube is guided in counterflow to the solid. A volume of gas charged with solid is provided in each spiral chamber in the free zone between the central tube and the lifting blades, which volume of gas is produced by the clouds of the product which pour from the lifting blades which are moved in an upwards direction. When the gas and solid are guided in a counterflow direction, these zones may be compared to mechanically supported fluidized columns. The total number of turns along the length of the rotary tube corresponds to the total number of fluidized columns which are connected in tandem.

This rotary tube which is to be regarded as a multistage fluidized (bed) reactor should be charged as evenly as possible with solid in the free space of each spiral on account of the intensive contact with gas. It has been found that the lifting blades are appropriately and positively arranged depending on the angle of repose and the pourability of the product. Correspondingly, a relatively high difference in pressure is produced between the gas inlet and outlet points when the tube is in operation. It has been shown that if the solid substance is well distributed throughout the gas, the pressure drop which is caused by the fluidized column

EXAMPLE 1

The production of magnetite from hematite by reduction with hydrogen.

Needle-shaped $\alpha$-$Fe_2O_3$ (hematite) having a grain size of from 0.5 to 2 mm and a specific surface of 29 $m^2/g$ which is obtained by dehydrating $\alpha$-FeOOH (goethite), is continually passed from a storage bin via a conveyor belt weigher into the rotary tubular kiln. The gas-tight rotary tube, which may be indirectly heated, has a heating stretch of 2 m with an inner diameter of 30 cm, which stretch is divided into 3 separately controllable zone. The inner baffles consist of the sealed spiral which has 43 turns. In each spiral chamber 16 positively arranged lifting blades which have an angle of 25° are arranged in a uniform manner over the periphery. The height of the lifting blades is 35 mm. The central tube has a diameter of 76 mm. The length of this channel is about 25 m.

At a set speed of 2 r.p.m., a residence time of about 20 mins is maintained. Seen from the direction of passage of the solid, the temperature in the first zone is maintained at 420° C. and the temperature in the second and third zone is maintained at 440° C. At a charging quantity of hematite of 24 kg/h, the degree of filling is 11.5 %. The quantity of hydrogen which is supplied in counterflow is 3 $Nm^3/h$. A further 1 $Nm^3/h$ of water vapor is additionally fed in. A charge of 0.75 $Nm^3/h$ of nitrogen serves to seal the tops of the kiln. The pressure drop in the moving rotary tube is 10 mm, in the stationary rotary tube it is 4 mm water column.

About 23 kg/h of magnetite having an FeO content of 30 % is continuously obtained at the outlet of the kiln. After the product has been thermally treated at 100° C. under a nitrogen atmosphere with 6.5 %, by volume, of oxygen, the FeO content is reduced to from 25 to 27 %. The needle-shaped magnetite which is now stabilized, has a specific surface of 28 $m^2/g$. The orientability (squareness ratio) is 0.90, measured in a magnetic field of 3000 Oe. The coercive force is 450 Oe. Thus the product which is obtained is extremely suitable for use as magnetic recording material.

Comparative experiments in a rotary tube which has the same dimensions, but which only has spiral strips as inner baffles, have shown that at the same temperature and at the same throughput of hydrogen, only half the weight quantity of hematite could be reduced. In addition, the specific surface of the resulting stabilized magnetite was only 24 $m^2/g$ at a relatively low orientability of 0.85.

EXAMPLE 2

The production of metallic iron particles by the reduction of goethite by means of hydrogen.

$\alpha$-FeOOH (goethite) is charged in a quantity of 2 kg/h into the rotary tube which is described in Example 1. The grain size of the material which is supplied is from 0.5 to 2 mm. The specific surface is 56 $m^2/g$. The temperature of the reaction tube, which has an incline of 4% and rotates at 2 r.p.m., is fixed at up to about 430° C. in the three heating zones. The quantity of hydrogen which is supplied in the direction of counterflow is 15 $Nm^3/h$. 2 $Nm^3/h$ of nitrogen are additionally introduced via the tops of the kiln. 1.25 kg of pyrophoric iron which has a metal content of 98.5% are obtained per hour. The specific surface of the needle-shaped iron is 20 $m^2/g$, the coercive force is 1100 Oe. The product is particularly suitable for incorporating into magnetic tapes.

It will be appreciated that the instant specification and examples are set forth by way of illustration and not limitation, and that various modifications and changes may be made without departing from the spirit and scope of the present invention.

We claim:

1. In a process for carrying out a gas-solid reaction wherein solids are contacted with a gas, the improvement comprising: providing a rotary tubular kiln having two ends, an outer tube, a central tube sealed at both ends and running the length of the kiln and a spiral between the central and outer tubes and fixed to the central tube and outer tube; feeding the solids into one end of the kiln between the central and outer tubes; providing lifting blades on the inner periphery of the outer tube within the spiral and terminating at an inner edge spaced apart from the central tube to lift the solids during rotation of the outer tube; feeding gas into the rotary kiln between the central and outer tubes; and rotating the outer tube, inner tube, spiral and blades to convey the solids via the spiral to the other end of the kiln.

2. The process according to claim 1, wherein the gas is fed countercurrent to the direction of conveyance of the solids.

3. The process according to claim 1, wherein the solids comprise hematite and the reaction product comprises magnetite.

4. The process according to claim 1, wherein the solids comprise iron oxide and the reaction product comprises metallic iron.

* * * * *

UNITED STATES PATENT AND TRADEMARK OFFICE

CERTIFICATE OF CORRECTION

PATENT NO. : 4,629,500

DATED : December 16, 1986

INVENTOR(S) : Helmut Janz et al.

It is certified that error appears in the above-identified patent and that said Letters Patent is hereby corrected as shown below:

In the Grant Only, insert columns 3 and 4.

Signed and Sealed this

Twenty-sixth Day of April, 1988

*Attest:*

DONALD J. QUIGG

*Attesting Officer*

*Commissioner of Patents and Trademarks* is much greater than the pressure drop which is caused by the curved channel flow with a stationary loose material.

It is advantageous if the height of the lifting blades, indicated by h in FIG. 2, is calculated in such a way that the remainder of the solid which falls from the lifting blades does not come into contact with the inner central tube. This guarantees that there is no mixing of the product from one spiral chamber into the other.

The advantage of the rotary tubular kiln, according to the present invention, is that there is an improved contact between gas and solid, resulting in a greater use of the gas to be reacted when it is guided in a counterflow direction.

A narrow residence time spectrum of the particles of solid matter is simultaneously achieved. Control of the residence time is simplified, since in large areas it is only influenced by the speed and not by the charging quantity and the incline of the kiln. The degree of filling of the rotary tube is more readily adjustable, since it is dependent on the charging quantity and to a lesser extend on the speed and the incline of the kiln.

The capacity of the rotary tubular kiln, according to the present invention, may be substantially increased in comparison with conventional processes, without this inevitably entailing a deterioration of the product. In many cases the properties regarding quality may be improved. The temperature of the kiln which is required may frequently be lowered at the same or at a shortened residence time, and not only does this mean a saving in heating energy but it also causes improvements in the properties of the material for heat sensitive substances. The influence of the grain spectrum on the quality of the product is markedly reduced, and thus a homogeneous quality of the product is achieved.

The rotary tubular kiln, according to the present invention, may be commercially used in many fields for reaction processes, carried out continuously, in which gases are reacted with pourable, non-tacky solid substances. It may also be used, in principle, for thermal treatments, such as for heating or cooling operations or for annealing under various gas atmospheres. It is unimportant whether chemical reactions or only physical processes, such as heat transmission from gas to solid, are taking place in the material to be treated.

A further object of the present invention is thus also the use of the rotary tubular kiln for various processes. By way of example, the rotary tubular kiln, according to the present invention, may be used for oxidation, reduction, chlorination, roasting, decomposition, catalytic annealing or cooling processes. The use of the rotary tubular kiln for the production of finely-divided metals or metal oxides by reducing relatively high grade oxides with reducing gases, in particular for the production of finely-divided iron oxides with a defined degree of oxidation and metallic iron for the purposes of magnetic recording, is preferably an object of the present invention.

The advantage of the use according to the present invention is particularly effective in magnetic recording materials of this type, since these products have a tendency to sinter easily during thermal treatments on account of their finely-divided nature, and the magnetic data of these qualitatively high grade products are at the same time substantially conditioned by a narrow particle spectrum.

Also the production of metals such as tungsten, copper or nickle may be advantageously carried out in the rotary tubular kiln, according to the present invention. The production of mixed phase pigments, active carbon and ceramic solids is also possible in kilns of this type, to name but a few examples.

The rotary tubular kiln is shown in diagrammatical form in the accompanying drawing, wherein.

Figure 1:
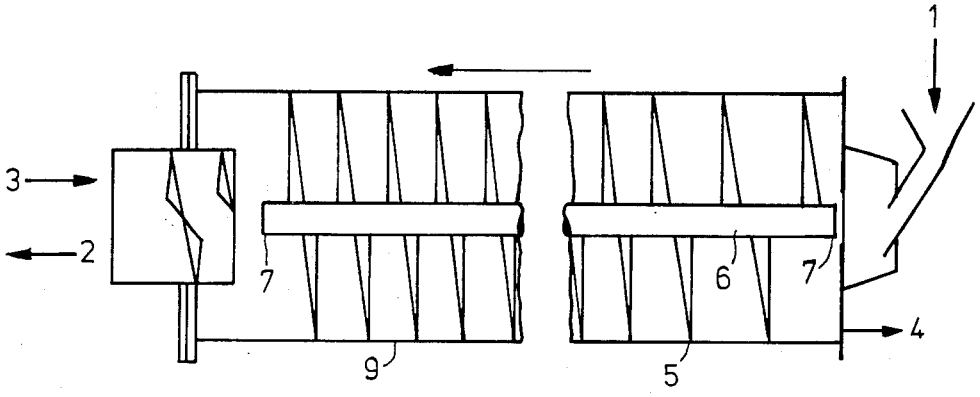
FIG. 1 is a longitudinal section through the rotary tube.

In FIG. 1, the solid is introduced into the rotary tube by means of a product charging hopper 1. It is then passed in the indicated direction through the spiral 5 which is tightly fixed between the outer rotary tube 9 and the inner central tube 6, corresponding to the speed of the rotary tube. The product which has been treated emerges at 2 from the rotary tube. In counterflow thereto, the reaction gas or the process gas is supplied to the rotary tube at 3. So that the gas flows towards the solid matter in a spiral-shaped manner corresponding to the spiral, the inner central tube 6 is provided at both ends with sealing tops 7. The gas is led out of the rotating reaction tube at 4.

Figure 2:
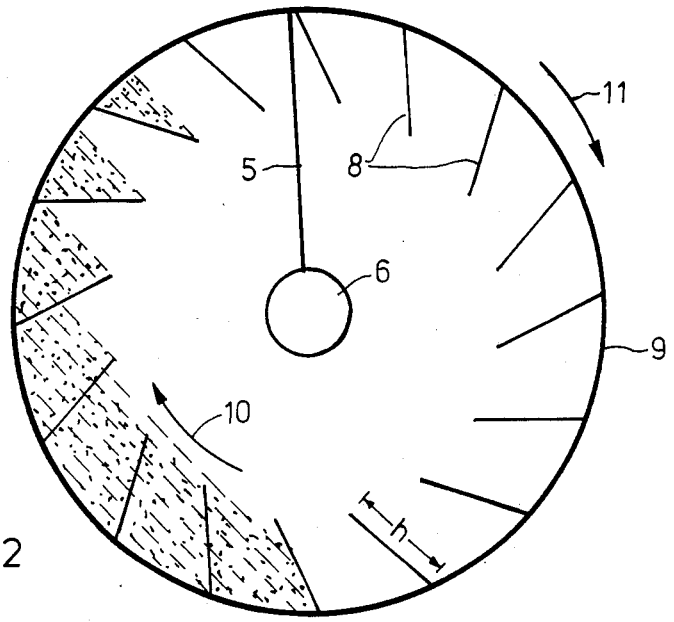
FIG. 2 is a cross section of the rotary tube.

The cross section in FIG. 2, shows in diagrammatic form the proportion of solid which rests as loose material on the lifting blades 8 which are arranged in a uniform manner over the inner periphery of the outer rotary tubular kiln 9. 10 shows the direction of rotation of the flow of gas towards the clouds of the product which fall from the blades 8, and 11 shows the direction of rotation of the reaction tube.

The dimensions of the baffles are dependent on the quantity flows which are provided, the requisite material ratios and the properties of the reaction components which are specific to the product. The grain size, grain distribution, angle of repose and the density of the solid substances are all important criteria as well as the viscosity and the density of the gases to a lesser extent, criteria, which are also important in fluidized bed technology.

If the diameter and length of the rotary tube, the pitch of the spiral, the diameter of the central tube, and the number, shape, height and arrangement of the lifting blades are set, sufficient possibilities are provided for influencing the behavior of the operation. Parameters which may be varied are the charging quantity, the temperature profile, the number of revolutions of the rotary tube, the quantity of gas, the proportion of inert gas and the outlet temperature of gas and solid.

The speed should be chosen in such a way that the material is lifted sufficiently often. If the speed is too slow, the loose material rests too long on the lifting blades. If the residence time at a given length of reactor and at a normal speed is not sufficient for the complete conversion, it is useful to operate the rotary tube alternately in both directions of rotation, the direction of rotation of which determines the length of time of the passage of the product. At the same speed, longer residence times are obtained using this measure. The arrangement of the lifting blades is no longer advantageous in this particular method.

The degree of filling of the rotary tube is most preferably set in such a way that the product does not shoot over the lifting blades.

The use according to the present invention of the rotary tubular kiln will be further explained in the following examples, which are not intended to be restrictive of the scope of the invention.